United States Patent [19]

Ziemek et al.

[11] Patent Number: 4,749,823

[45] Date of Patent: Jun. 7, 1988

[54] MULTI-WIRE ELECTRIC POWER CABLE, PARTICULARLY A SUPPLY CABLE FOR BOREHOLE UNITS

[75] Inventors: Gerhard Ziemek, Langenhagen, Fed. Rep. of Germany; Dimitri R. Stein, Larchmont, N.Y.; Victor A. Viggiano, Franklin Lakes, N.J.

[73] Assignee: kabelmetal electro Gesellschaft mit beschränkter Haftung, Hanover, Fed. Rep. of Germany

[21] Appl. No.: 35,220

[22] Filed: Apr. 6, 1987

Related U.S. Application Data

[63] Continuation of Ser. No. 768,893, Aug. 23, 1985, abandoned.

[30] Foreign Application Priority Data

Oct. 5, 1984 [DE] Fed. Rep. of Germany ..... 3436516

[51] Int. Cl.[4] ..... H01B 7/18

[52] U.S. Cl. ..... 174/103; 138/122; 138/173; 174/102 D; 174/106 R; 174/106 D; 174/109

[58] Field of Search ..... 174/102 D, 103, 106 R, 174/106 D, 108, 109; 138/121, 122, 173

[56] References Cited

U.S. PATENT DOCUMENTS

| | | | |
|---|---|---|---|
| 1,275,279 | 8/1918 | Lutz | 174/109 |
| 1,314,333 | 8/1919 | Kahn | 138/121 |
| 1,826,666 | 10/1931 | Lawrence | 138/121 |
| 2,164,168 | 6/1939 | Wertzheiser et al. | 174/109 |
| 2,259,850 | 10/1941 | Zundorf | 174/109 |
| 2,531,917 | 11/1950 | Mollerhoj et al. | 174/106 R |
| 2,870,792 | 1/1959 | Penrose | 138/121 |
| 3,582,536 | 6/1971 | Miller | 174/102 D |
| 3,831,636 | 8/1974 | Bittner | 174/108 X |
| 4,282,398 | 8/1981 | Solomon | 174/106 R |
| 4,449,013 | 5/1984 | Garschick | 174/103 |
| 4,453,036 | 6/1984 | Neuroth | 174/103 |

FOREIGN PATENT DOCUMENTS

| | | | |
|---|---|---|---|
| 1232228 | 1/1967 | Fed. Rep. of Germany | 174/106 R |
| 2853100 | 6/1980 | Fed. Rep. of Germany | 174/103 |

*Primary Examiner*—Morris H. Nimmo
*Attorney, Agent, or Firm*—Martin A. Farber

[57] ABSTRACT

In a multi-wire electric power cable, particularly a supply cable for borehole units such as pumps, each insulated wire is protected by a corrugated sheath. In order to be able to withstand high pressures of, for instance, 300 bar, the corrugation of the corrugated sheaths is so developed with respect to depth and pitch of corrugation that the length of each corrugated sheath is between 33 and 67%, and preferably 45 to 55%, shorter than the smooth tube from which it has been produced.

9 Claims, 1 Drawing Sheet

MULTI-WIRE ELECTRIC POWER CABLE, PARTICULARLY A SUPPLY CABLE FOR BOREHOLE UNITS

RELATED APPLICATION

This application is a continuation of our co-pending application Ser. No. 768,893 filed Aug. 23, 1985 now abandoned.

FIELD AND BACKGROUND OF THE INVENTION

The invention relates to a multi-wire electric power cable, particularly a supply cable for borehole units, for example pumps, in which each of the wires which lie alongside of the other is protected individually by a closed metallic covering in the form of a corrugated tube.

For the production of oil or gas wells drive elements are used which are introduced to depths of 3000 m and more. These drive elements, particularly pumps, are provided with electric power from the surface of the earth. For this purpose, electric cables are required which must satisfy very specific requirements. There must be taken into account, on the one hand, the pressure conditions which prevail at these depths and which require that the cable be correspondingly resistant to pressure, while, furthermore, account must also be taken of temperatures which are about 120° C. and more, in addition to the temperatures produced by the drive elements in the form of heat loss. Another requirement for the operation of the cables over a long period of time is a substantial lack of sensitivity to corrosive agents present in the borehole or shaft, such as, for instance, corrosive gases or else seawater when the holes are made in the bottom of the sea.

From Federal Republic of Germany OS No. 2853100 a cable for this purpose is known in which each wire is surrounded by a corrugated metal sheath. The individual adjacent wires surrounded by a corrugated sheath are, in accordance with a further concept of the known arrangement, themselves surrounded by a corrugated metal sheath. Since this corrugated sheath is necessarily round as a result of the process, there results for the cable a diameter which permits the use of this cable in only a few cases. For example, if the space between the borehole casing and the so-called drill pipe to which the cable is customarily fastened is very small, the known construction cannot be used. Furthermore, the relatively large corrugated sheathing leads to poorer resistance of the structure to pressure. In accordance with another proposal made in the foregoing Federal Republic of Germany OS No. 2853100, each corrugated tube surrounding the adjacent wires is surrounded by an armoring of high-strength steel wires, over which a tape wrapping which is common to all wires is then applied. The armoring of high-strength steel wires serves essentially to take up tensile forces. The purpose of the tape wrapping is to keep the three wires in the desired position. In order to achieve resistance to pressures on the order of magnitude of 200 bar with this construction, it is necessary, in the case of a predetermined inside diameter of the corrugated tube, which is determined by the outside diameter of the electrical insulation of the wires, to increase the wall thickness of the corrugated tube, as a result of which, however, the flexibility of the cable is substantially reduced. The suggestion of using a so-called double corrugated sheathing also failed to lead to a substantially higher pressure-withstanding capacity of the corrugated tube.

It is an object of the invention to improve the cable of the aforementioned type so as to obtain a resistance to pressures of more than 200 bar, and preferably more than 300 bar, without great expense. In addition, the cable is to have a sufficiently high longitudinal tensile strength.

SUMMARY OF THE INVENTION

According to the invention, the corrugation of the tubes (5) with respect to depth and pitch of corrugation is such that the length of the corrugated tubes (5) is shorter by between 33% and 67%, and preferably 45% to 55%, than the smooth tube from which they are made.

The adjacent wires are, to particular advantage, surrounded by a flexible metallic armoring (7) which consists of a metal tape applied helically with overlapping tape edges, the metal tape being so deformed as seen in cross section, that the edges of the tape engage in one another in force-locked and form-locked manner in the overlap region.

While in the known cable the corrugation of the metal tubes led to a shortening of about 15%, a corrugation which leads to a shortening of preferably 45 to 55% is selected in the present invention.

The present invention has proceeded from the basis that the resistance of a tube to external pressure can be described by the formula $$P\ \text{critical} = \frac{\sigma \cdot s}{r_m} \times \frac{l_0}{l_1}$$

in which $\sigma$ is the yield point of the metal, s the wall thickness of the tube, $r_m$ the mean radius $(r_a+r)/2$ of the corrugated tube and $l_o/l_l$ the ratio of the smooth tube of length 1 to the corresponding length of the corrugated tube. It is known that the yield point of metals can be increased by cold working. If the shortening of the smooth tube is taken as a measure of the cold working, since this shortening at the same time also includes the depth of corrugation, then the critical pressure can be established as $$P\ \text{critical} = \sigma f\left(\frac{l_0}{l_1}\right) \cdot \frac{s}{r_m} \cdot \frac{l_0}{l_1}$$

If the relationship between $\sigma$ and the cold-working $l_o/l_l$ is known, we can write $$P\ \text{critical} = a \cdot \sigma \cdot (s/r_m) \cdot b$$

where a and b are constants.

It has been found that in the case of austenitic steels the increase in the critical pressure takes place at values of a of between 1.3 and 3 and of b between 1.3 and 4.

In addition to this, the high resistance to pressure which is obtained by the shortening of the smooth tube into a corrugated tube refers furthermore to a smaller mean radius.

It is of decisive importance that the shortening of the smooth tube not be neutralized elastically or plastically. Lengthening of the cable is opposed by the armoring, which is applied helically. The particular construction of the armoring is extremely flexible, i.e. it does not limit the flexibility of the cable, but it reliably prevents a lengthening of the corrugated tubes in the event that they are arranged vertically or as a result of high pressure.

In accordance with one particularly advantageous development, both the corrugated tubes (5) and the metal tape (7) of the armoring consist of austenitic steel. It has been found that, in particular, austenitic steels lead to extensive cold working. The use of a metal tape which also consists of austenitic steel serves for resistance to corrosion. In certain cases of use, however, other materials can also be used, for instance galvanized steel, copper or copper alloys, in which case, however, it must be assured that the combination of materials does not lead to increased attack by corrosion. Each corrugated tube (5) can bear a braid (6) of threads, preferably metal wires, preferably of high-grade steel. Such a braid can increase both the resistance to pressure of the tube and the tensile strength of the cable structure. The ratio of tube outside diameter to wall thickness should be between 60 and 125, and the ratio of depth of corrugation to wall thickness between 8 and 25. The corrugated tubes (5) are seated tightly on the insulation (4) of the wires so that displacement of the wires within the corrugated tube is not possible.

In accordance with another feature of the invention the corrugations of the corrugated tubes have a generally rectangular form.

BRIEF DESCRIPTION OF THE DRAWINGS

With the above and other objects and advantages in view, the present invention will become more clearly understood in connection with the detailed description of preferred embodiments, when considered with the accompanying drawings, of which.

Figure 1:
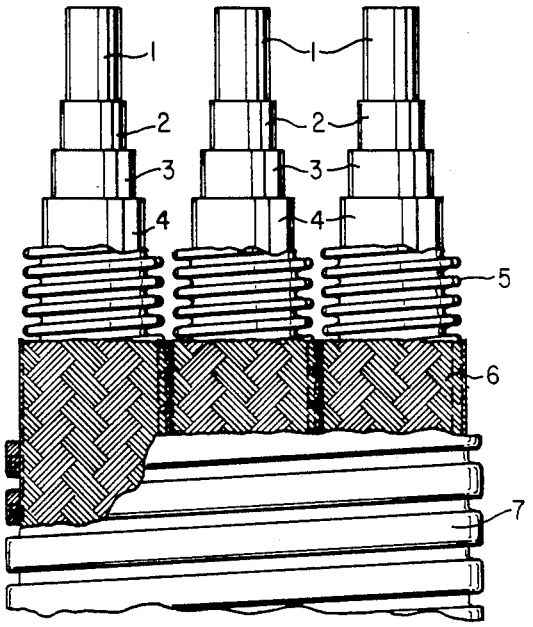
FIG. 1 is a plan view of the cable, partly broken away.
Figure 2:
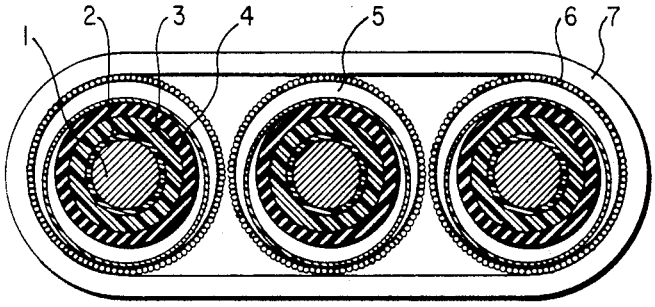
FIG. 2 is a cross section through the cable.

DETAILED DESCRIPTION OF THE gated tube 5, which is applied in continuous operation to each of the wires, is applied on the outer surface of the layer 4. In this connection a continuously moving wire is wrapped with a longitudinally introduced metal tape; the latter is formed around the wires to form a tube, the longitudinal seam is welded, and the tube is then corrugated. In this way, armored wires of practically any length can be produced, so that the splicing of lengths of cable to each other at the place of use is reduced to a minimum. The corrugated tube 5, which advantageously consists of austenitic steel, is furthermore wrapped with a braid 6 of individual wires, also of austenitic steel. All three wires are surrounded by a common armoring 7 which lies tightly on the metal braid 6 and the corrugated sheaths 5. The armoring 7 is formed of a metal tape which is applied helically to the wires. The tape edges of two adjacent turns grip in claw-like manner into one another and thus assure a force-locked and form-locked connection between the individual turns. Austenitic steel is also preferred as material for the armoring 7.

In accordance with one feature of the invention, the corrugated tube 5 is so corrugated as to result in a shortening of the tube by about 50%. A method by which such a corrugation can be produced in continuous operation, i.e. in practically unlimited lengths, has been developed for the first time in the Applicant's company and forms the object of the U.S. Pat. No. 4,663,954 the disclosure of which is hereby incorporated by reference herein.

Various cables constructed in accordance with the teaching of the invention were subjected to pressure tests, obtaining the results set forth in the Table. In the case of test specimens 5, 7 and 8, the test was interrupted after the test pressure had been reached. The Table clearly shows that pressures of more than 340 bar can be withstood, without great financial expense, by means of the deeply corrugated tubes.

As used herein, cold-working is a working of a metallic material below its recrystallization temperature.

| tube dimensions | wall thickness | test pressure | burst pressure | core | braid | material | corrug. depth | date |
|---|---|---|---|---|---|---|---|---|
| 41,2/30,5/4,2 | 0,4 mm | — | ~340 kg/cm$^2$ | — | — | stainless steel | 4,95 mm | 24.8.84 |
| 41,0/30,4/4,9 | 0,4 mm | — | ~340 kg/cm$^2$ | — | — | stainless steel | 4,90 mm | 24.8.84 |
| 39,3/27,4/6,4 | 0,5 mm | — | 220 kg/cm$^2$ | — | — | steel | 5,45 mm | 27.8.84 |
| 38,5/25,4/4,1 | 0,5 mm | — | 220 kg/cm$^2$ | — | — | steel | 6,05 mm | 27.8.84 |
| 41,3/30,1/5,6 | 0,5 mm | 350 kg/cm$^2$ | — | — | — | stainless steel | 5,1 mm | 28.8.84 |
| 41,5/29,8/3,9 | 0,5 mm | — | 500 kg/cm$^2$ | — | — | stainless steel | 5,35 mm | 28.8.84 |
| 41,4/29,7/3,1 | 0,5 mm | 400 kg/cm$^2$ | — | yes | — | stainless steel | 5,35 mm | 29.8.84 |
| 41,4/29,7/3,1 | 0,5 mm | 520 kg/cm$^2$ | — | — | — | stainless steel | 5,35 mm | 29.8.84 |

Remarks:
In test no. 5 the tube did not fail at 350 kg/cm$^2$ but the end sealing in the test equipment was gone.

PREFERRED EMBODIMENT

The cable consists of three electric conductors 1 lying alongside of each other—either solid or a stranding of individual wires—over which a thin layer 2 of a polyimide is applied. Over the layer 2, the actual electric insulation 3 is disposed, it consisting of an ethylene-propylene compound. This insulating material is characterized by high resistance to temperature and moisture. A layer 4 of nitrile rubber is furthermore placed over the layer 3. Said material is resistant to oil and has excellent mechanical properties. The deeply corrugated corru-

We claim:

1. In a multi-wire electric power cable, particularly a supply cable for borehole units including pumps, in which insulated wires lie alongside each other and are protected individually by a set of closed metallic coverings in the form of corrugated tubes, there being one of said tubes for each of said insulated wires, the improvement wherein a deep corrugation of the tubes with respect to depth and pitch of corrugation is such that the length of the corrugated tubes is shorter by 33% to 67%, and preferably 45% to 55%, than the smooth tubes from which the corrugated tubes are made, a ratio of tube diameter to wall thickness is between 60 and 125, and a ratio of depth of corrugation to wall thickness is between 8 and 25, each of said corrugated tubes being formed of a cold-worked metal; the power cable further comprising means comprising a braid of threads wrapping each of said corrugated tubes for restraining elongation of the corrugated tubes in the presence of elevated pressure of an environment external to the power cable; and a single flexible metallic armor which flexibly surrounds in common all of said braids, said armor comprising a metal tape applied helically with overlapping tape edges about all of said corrugated tubes.

2. The multi-wire electric power cable according to claim 1, wherein the metal tape is so deformed as seen in cross section, that edges of the tape engage in one another in locked mating relationship in the overlap region, said corrugations of said corrugated tubes having a generally rectangular form.

3. The multi-wire electric power cable according to claim 1, wherein both the corrugated tubes and the metal tape of the armor are made of austenitic steel.

4. The multi-wire electric power cable according to claim 2, wherein both the corrugated tubes and the metal tape of the armor are made of austenitic steel.

5. The multi-wire electric power cable according to claim 1, wherein said threads are metal wires.

6. The multi-wire electric power cable according to claim 1, wherein said threads are high-grade steel.

7. The multi-wire electric power cable according to claim 1, wherein each of the insulated wires is protected by a layer of insulation, and the corrugated tubes are seated tightly on the insulation.

8. An electric power cable resistant to pressure of an environment external to the cable, comprising:

a plurality of electrical conductors disposed alongside each other, each of said conductors being enclosed by a tubular protection means providing electrical insulation each of said protection means comprising a corrugated tube having parameters of corrugation depth and corrugation pitch selected to provide that the length of the corrugated tube is shorter by a factor in the range of $\frac{1}{3}$ to $\frac{2}{3}$ than a smooth tube from which the corrugated tube is fabricated;

each of said protection means further comprising a braid of cross-wrapped threads wrapped circumferentially about the corrugated tube to restrain an elongation of the corrugated tube induced by pressure external to the power cable; and wherein in each of said tubes, a ratio of tube diameter to wall thickness is between 60 and 125, and a ratio of depth of corrugation to wall thickness is between 8 and 25, each of said corrugated tubes being formed of a cold-worked metal; and said power cable further comprises a common armor surrounding all of said conductors and their respective protection means, said armor being formed of a tape helically wound upon the braids enclosing the respective conductors, successive turns of the helically wound tape having interlocking edges for engagement with contiguous turns of the tape to restrain an elongation of each of said corrugated tubes induced by pressure external to the power cable.

9. A cable according to claim 8, wherein said tape, said threads and said tubes are made of steel; and each of said protection means further comprises a layer of insulation disposed between the corrugated tube and the corresponding conductor, said corrugations of said corrugated tubes having a generally rectangular form.

* * * * *